US005423706A

United States Patent [19]

Chase

[11] Patent Number: 5,423,706

[45] Date of Patent: Jun. 13, 1995

[54] TOY AIRCRAFT GLIDER WITH ROTATING AND FOLDING WINGS

[76] Inventor: George W. Chase, 16121 St. Croix Cir., Huntington Beach, Calif. 92649

[21] Appl. No.: 189,081

[22] Filed: Jan. 28, 1994

[51] Int. Cl.[6] ..... A63H 27/00; A63H 33/20; A63H 5/00

[52] U.S. Cl. ..... 446/62; 446/50; 446/213

[58] Field of Search ..... 446/62, 61, 63, 66, 446/67, 68, 34, 49, 50, 51, 52, 54, 213, 216

[56] References Cited

U.S. PATENT DOCUMENTS

| | | | |
|---|---|---|---|
| Re. 25,734 | 2/1965 | Boese . | |
| 1,116,122 | 11/1914 | Reiss . | |
| 1,446,110 | 2/1923 | Williams | 446/66 X |
| 1,599,280 | 9/1926 | Lewis . | |
| 1,771,991 | 8/1930 | Bissiri . | |
| 1,800,778 | 4/1931 | Carson | 446/215 |
| 1,842,434 | 1/1932 | Tyrrell . | |
| 1,920,746 | 8/1933 | Guillow . | |
| 1,974,656 | 9/1934 | Nelson . | |
| 2,059,131 | 10/1936 | McGall . | |
| 2,078,374 | 4/1937 | Drobniewsky . | |
| 2,128,747 | 8/1938 | Johnson . | |
| 2,136,067 | 11/1938 | Witte . | |
| 2,158,377 | 5/1939 | O'Hare . | |
| 2,191,305 | 2/1940 | Betts . | |
| 2,202,978 | 6/1940 | Bass . | |
| 2,221,012 | 11/1940 | Walker | 446/62 |
| 2,228,697 | 10/1941 | Emmick, Sr. . | |
| 2,268,487 | 12/1941 | Jacobs . | |
| 2,306,866 | 12/1942 | Crary . | |
| 2,417,267 | 3/1947 | Porter . | |
| 2,538,522 | 1/1951 | Jackle . | |
| 2,748,529 | 6/1956 | Swan | 446/52 |
| 2,836,930 | 6/1958 | Ragazzo et al. | 446/213 |
| 2,876,585 | 3/1959 | Zaic | 446/66 |
| 3,222,817 | 12/1965 | Brandstetter . | |
| 3,408,767 | 11/1968 | Anderson | 446/62 |
| 3,433,210 | 3/1969 | Schnitz | 446/62 X |
| 3,496,671 | 2/1970 | Korona | 446/50 |
| 3,839,818 | 10/1974 | Heggedal . | |
| 3,916,560 | 11/1975 | Becker . | |
| 3,943,657 | 3/1976 | Malcolm . | |
| 4,356,662 | 11/1982 | Strasser et al. | 446/52 |
| 4,863,412 | 9/1989 | Mihalinee | 446/62 X |

FOREIGN PATENT DOCUMENTS

| | | | |
|---|---|---|---|
| 1071879 | 3/1954 | France | 446/51 |
| 451715 | 11/1927 | Germany | 446/62 |
| 504444 | 4/1939 | United Kingdom | 446/50 |
| 2227950 | 8/1990 | United Kingdom | 446/62 |

OTHER PUBLICATIONS

1984 Paul Gunther KG D-8330—Packaging for a toy airplane purchased at a Southern Califorina toy store.

*Primary Examiner*—Robert A. Hafer
*Assistant Examiner*—D. Neal Muir
*Attorney, Agent, or Firm*—Knobbe, Martens, Olson & Bear

[57] ABSTRACT

A toy aircraft glider for launching by a slingshot, having two-axis wing retraction for improved launch height and wing stability, internally-mounted wing deployment springs for improved toy life, the ability to eject smaller toys while airborne to enhance toy enjoyment, sound effects and remote control steering.

8 Claims, 8 Drawing Sheets

TOY AIRCRAFT GLIDER WITH ROTATING AND FOLDING WINGS

BACKGROUND OF THE INVENTION

This invention pertains to toy aircraft gliders. In particular, this invention pertains to a glider designed to be launched by a slingshot and having retractable wings, the ability to eject smaller toys while airborne, sound effects and remote control steering features in order to enhance performance, toy-life and enjoyment.

Slingshot-propelled gliders with retractable wings designed to minimize air resistance during launch, but which deploy to a fully-extended position after launch, are well known in the prior art. Many variations of hinges and pivots to retract and deploy the wings have been described. In much of the prior art, each wing rotates around a single axis in order to retract or deploy. In such designs, however, the wings remain in a horizontal plane at all times. An example is U.S. Pat. No. 2,538,533 issued to E. K. Jackle, where both wings are fixed horizontally by a single vertical pin located in the fuselage near the nose of the glider. The wings rotate around the vertical fuselage pin to retract to launch position and deploy to flight position.

An alternative design in the prior art allows each wing to rotate around two axes. A wing rotates from a horizontal to a vertical position around one axis and rotates towards the tail around a second axis. This retraction of a wing using two axes of movement allows each of the wing surfaces to be in a vertical plane when retracted. The advantage of a two-axis design over a single-axis design is that the air pressure against the planar surfaces of vertically retracted wings will hold them in a retracted position longer than the same amount of air pressure exerted upon the thin edges of horizontally retracted wings. The longer the wings stay in a retracted position, the greater the launch height that can be achieved.

Most of the prior art two-axis designs employ the same rubber band or spring to counter-rotate the retracted wings, around each axis, into their flight position. An example is U.S. Pat. No. 1,920,746 issued to R. M. Guillow. The disadvantage of these single rubber band or spring designs is that the amount of force acting to counter-rotate the wings away from the tail cannot be independently set from the amount of force acting to counter-rotate the wings from a vertical position to the horizontal flight position. The force holding the wings in a retracted position must be minimized to achieve maximum launch height. The vertical to horizontal counter-rotational force must be made sufficiently large to hold the wings at the proper flight angle. When the same rubber band or spring acts along both axes, the force counter-rotating the wings away from the tail is larger than the force holding the wings in their flight position, resulting in a sacrifice of either launch height or wing stability, or both. U.S. Pat. No. 2,268,487 issued to J. M. H. Jacobs appears to be the only two-axis design which incorporates an independent rubber band or spring along each axis.

A variety of rubber band and spring configurations used to counter-rotate the wings in both one-axis and two-axis designs have been described in the prior art. The various combinations of wing rotating mechanisms have, however, required external rubber bands or springs, which are subject to damage during the launch or landing of the toy gliders. A weakness in the Jacobs design is that it teaches the use of only two rubber bands or springs for accomplishing the counter-rotation of the wings, one for each axis. This requires both wings to share both of these rubber bands or springs, and Jacobs does not teach how to accomplish this without externally exposing the rubber bands or springs.

The prior art also describes mechanisms for the airborne release of smaller toy objects from the toy glider. As disclosed in U.S. Pat. No. 2,417,267, issued to H. M. Porter, a smaller toy can be held against the fuselage of a slingshot-propelled glider by a combination of a projection from the fuselage, a slot in either of the wings, and a loop on the smaller toy. When the wings deploy in flight, the weight of the smaller toy allows its loop to slide off the fuselage projection when the glider turns slightly in that direction.

In U.S. Pat. No. Re 25,734, issued to A. H. Boese, a rocket-shaped, slingshot-propelled toy includes two hollow half-sections hinged together at the nose section. The two halves are held together at the tail of the rocket by rubber bands wrapped around both sections and held in place by the hand of the person launching the rocket. A smaller toy can be placed inside the hollow halves of the rocket. After launch, the rubber bands securing the tail unravel, and a spring in the nose hinge at the nose forces the two half-sections to open. This allows the smaller toy to fall from the rocket.

In U.S. Pat. No. 2,136,067, issued to E. A. Witte, a figure-shaped metal plate forms the bottom portion of the toy glider fuselage. Above this plate, inside the fuselage, is packed a parachute attached to the figure. The feet of the figure are struck by the wings when deployed, which disengages the figure from the fuselage, allowing it to drop from the glider. Hence, the prior art mechanisms can release a smaller toy upon wing deployment, but rely on gravity to separate the smaller toy from the flight toy.

The prior art does not describe enhancements to increase interest in these slingshot launchable toy gliders other than the in-flight release of smaller toys. The prior art does not describe enhancements which emit sound from the toy gliders or which provide for control of the toy glider's flight path after launch.

SUMMARY OF THE INVENTION

This invention employs a two-axis wing retraction design where the counter-rotational forces urging the wings to their flight position are controlled by three independent, internally-mounted springs. Such a configuration provides for maximum launch height and maximum toy life. Maximum launch height is achieved by a two-axis design whereby each wing has an independent spring to urge the retracted wing away from the tail, the tension of which can be minimized. Both wings, however, share a single counter-rotational spring to urge the wings from a vertical position to a horizontal flight position, the tension of which can be maximized to achieve wing stability. Maximum toy life is achieved because each of these three springs can be located entirely within a wing or the fuselage, partially surrounded by these rigid surfaces of the glider.

This invention also provides an ejection mechanism to separate a smaller toy figure from the toy glider in flight. Although the separation of the smaller toy from the glider is triggered by wing deployment after launch, as in the prior art, it is achieved by a spring and does not depend on gravity. The advantage of this ejection mechanism is that it allows a toy figure to be placed in the cockpit of the glider, from which a gravity deployment mechanism would be unable to eject the figure. This placement gives the toy figure the appearance of piloting the glider. After the glider is airborne, the toy figure appears to eject upward and away from the glider, simulating the appearance of a real pilot ejecting from a real aircraft.

This invention also provides a whistle mechanism which may be activated immediately upon launch, if mounted in the nose of the glider or, activated only after the glider has achieved flight altitude, if mounted on the wings of the glider. If on the wings, a separate whistle may be mounted on each wing to give the appearance of the engine pods on a real jet aircraft.

This invention also provides an elevator and rudder in conjunction with a remote control mechanism to provide flight path control after the launch of the glider.

DESCRIPTION OF THE PREFERRED EMBODIMENT

Figure 1:
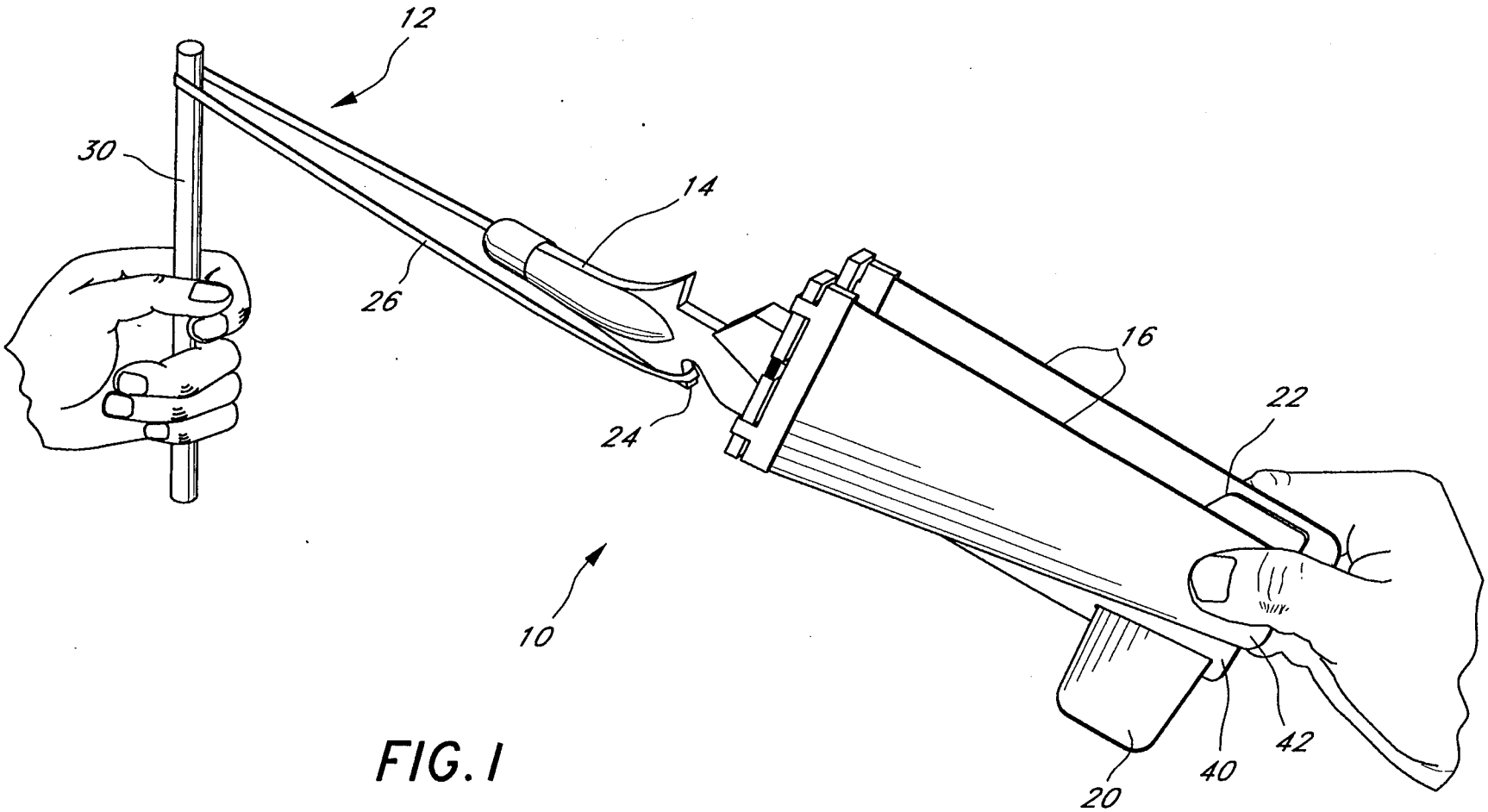
FIG. 1 is a perspective view of a toy aircraft constructed according to this invention, illustrating the manner of launching the same with the wings fully retracted.

Referring to FIG. 1, a toy aircraft glider 10, and a slingshot launching device 12, in accordance with the present invention, are shown. The toy aircraft glider 10 has a fuselage 14, foldable wings 16, a fixed horizontal tail stabilizer 20 and a fixed vertical tail stabilizer 22.

The fuselage 14 is provided with a launch hook 24 which receives the elastic band 26 of the slingshot launching device 12. The slingshot launching device 12 may take any of a number of forms, including the rod 30 shown, a traditional Y-shaped slingshot, or a forearm braced slingshot such as the commercially available Wrist Rocket. Also, other forms of launching devices may be used, such as, for example, a spring gun of the variety used to shoot darts. The elastic band 26 may also be attached to a projecting hook or other structural component of the fuselage 14.

The wings are preferably generally planar, which can include a certain amount of curvature to improve lift and other characteristics, as is well-known in the art.

Figure 2:
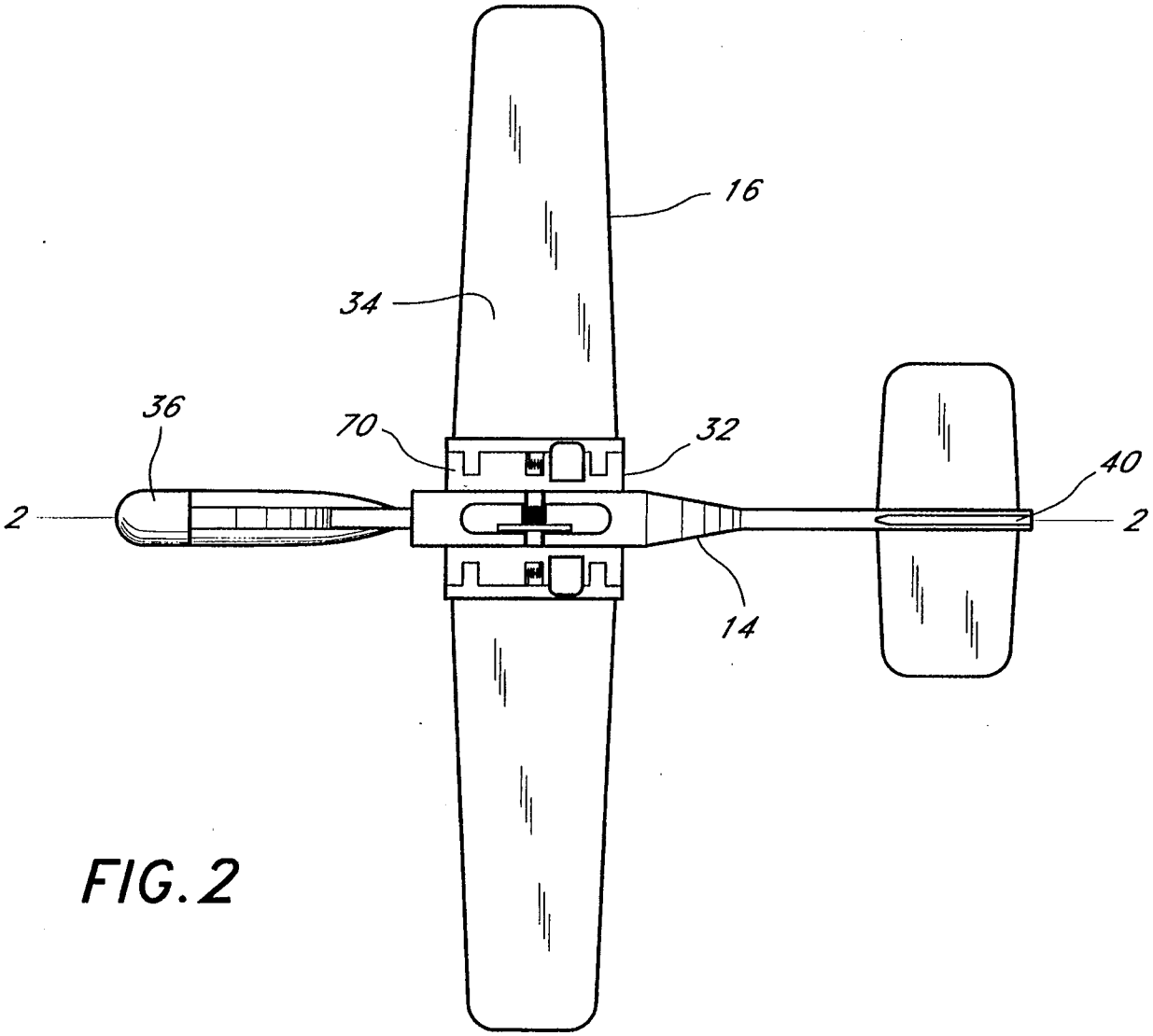
FIG. 2 is a top plan view thereof with the wings in flight position, illustrating the wing hinge assemblies, the fuselage pin which connects the hinge assemblies to the fuselage and the three springs used to achieve a two-axis rotation of the wings for retraction.
Figure 3:
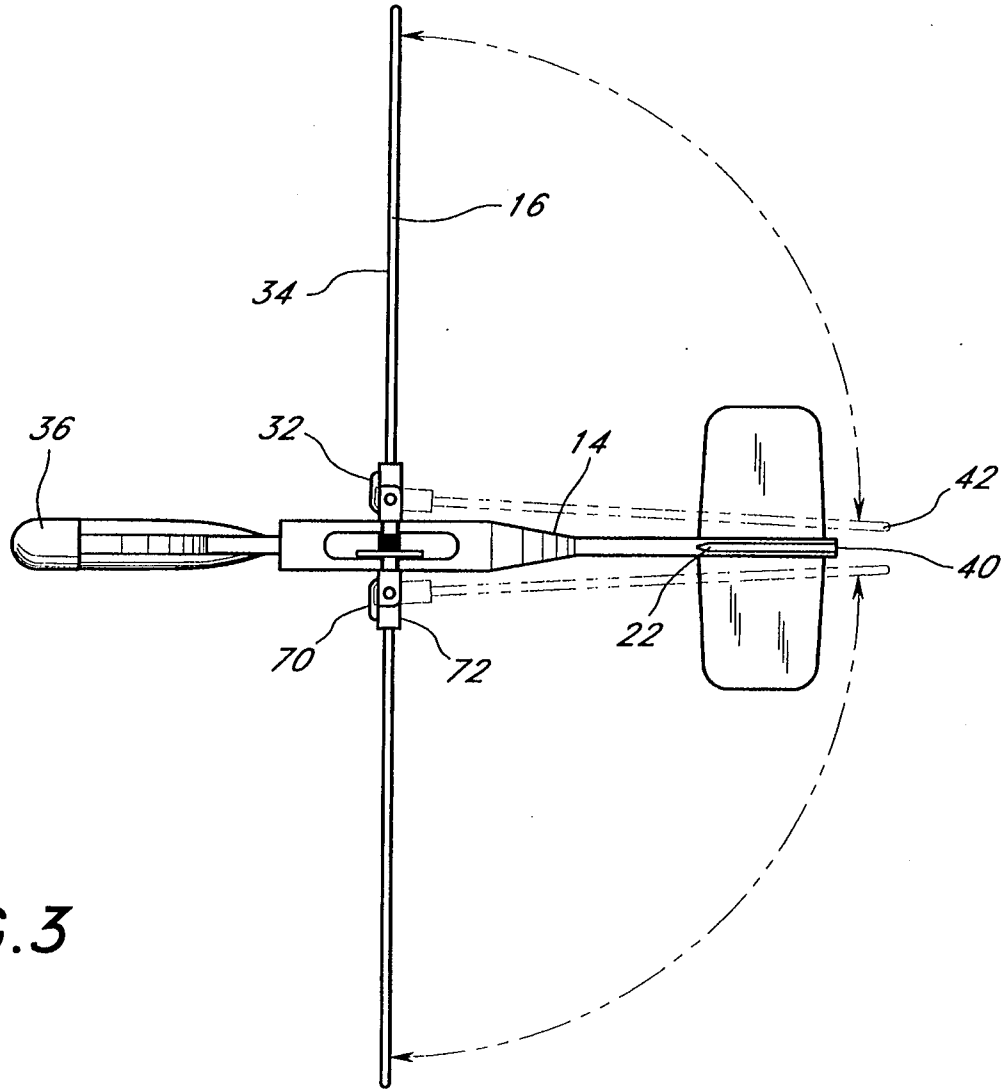
FIG. 3 is a top plan view similar to FIG. 2 showing the two axes of rotation, with the wings first shown rotated around an axis transverse to the fuselage to bring the wing surfaces to a vertical position and then rotated around an axis parallel to each wing surface to a position against the tail, ready for launch.

Referring to FIGS. 2 and 3, each wing 16 is attached to a hinge assembly 32. As shown in FIG. 3, the wings 16 can be rotated to a vertical position. This rotation of the wings can be accomplished by grasping the fuselage 14 with one hand and applying a twisting force to either wing 16 with the other hand. The hinge assemblies 32 are rigidly connected so that rotation of one wing 16 rotates the other. The upper wing surfaces 34 are rotated to a position facing the nose 36 as shown. Alternatively, the hinge assembly 32 can be structured so that the wings 16 are rotated in the opposite direction and the upper wing surfaces 34 face the tail 40.

As shown in FIG. 3, from the vertical position, each wing 16 can be individually folded against the vertical stabilizer 22 by pushing the wing 16 toward the tail 40 with one hand and then holding the wing tip 42 against the vertical stabilizer 22 with the other hand. The hinge assemblies 32 are constructed to allow the wings 16 to fold in this manner. FIG. 1 illustrates the folded position of the wings 16, which is the toy glider's launch position. Both wings 16 are held in the folded position by grasping the wing tips 42 between the thumb and forefinger of one hand as shown in FIG. 1. The wings 16 can also be held in the launch position with a separate clip or similar restraining device (not shown) and removed just before the toy glider is launched. Alternatively, a clip with a surface perpendicular to the fuselage 14 (not shown) can be attached to the tail 40 of the glider. This clip can hold the wing tips 42 together during launch. Air pressure after launch against the clip's perpendicular surface then forces the clip off the wing-tips 42, allowing the wings 16 to deploy normally. Such a clip frees one hand of the person launching the toy and allows portions of the toy glider besides the wing tips to be held during launch. A tail hook or grip may also be provided for increased leverage to allow further stretching of the elastic band of the slingshot and to launch the toy glider to greater heights.

Figure 4:
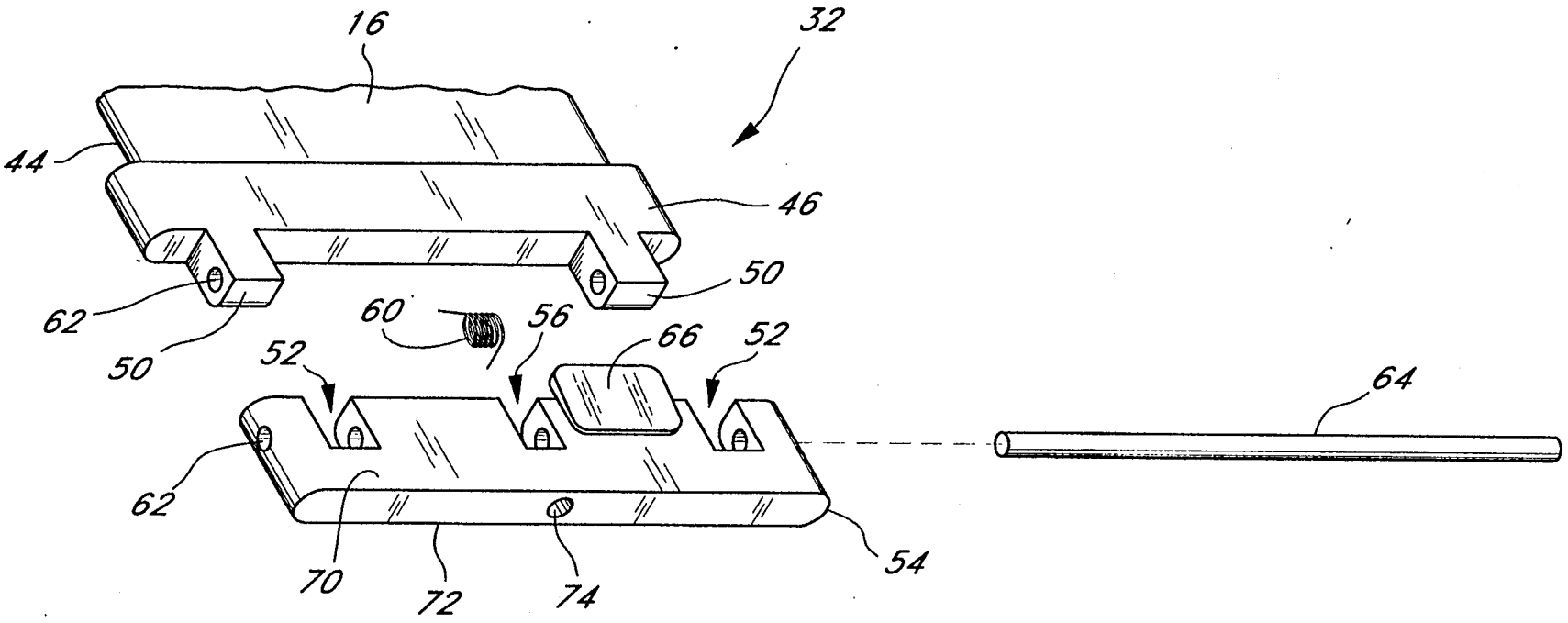
FIG. 4 is a top exploded view of the right wing hinge assembly illustrating the protected spring which applies a counter-rotational force to the hinge.

Referring to FIG. 4, each wing 16 is attached at its base 44 to a wing hinge piece 46 which has two hinge tabs 50 that mate with two hinge cutouts 52 in a fuselage hinge piece 54. The fuselage hinge piece 54 has a hinge spring cutout 56 that accommodates a hinge spring 60. A hinge pin hole 62 runs through the center of the hinge tabs 50 and through the center of the hinge cutouts 52. A hinge pin 64 is inserted through the hinge pin holes 62 to secure the wing hinge piece 46 to the fuselage hinge piece 54 and to secure the hinge spring 60 within the hinge cutout 56, creating a complete hinge assembly 32 for each wing 16. The hinge assemblies 32 allow each wing 16 to fold toward the fuselage and against the vertical stabilizer when a force is manually applied to the wing 16. This force causes the wing hinge piece 46 to rotate about the hinge pin 64 and opposes the force of the hinge spring 60 which tends to counter-rotate the wing hinge piece 46. A hinge stop 66 on each hinge assembly 32 allows each wing hinge piece 46 to fold in only one direction. The force of the hinge spring 60 holds the wing hinge piece 46 against the hinge stop 66 and holds the wings 16 in the flight position. The hinge stop 66 can be located on either the wing hinge piece 46 or the fuselage hinge piece 54. One of ordinary skill will recognize the hinge assembly disclosed above may be modified in a number of ways.

The hinge assembly 32 construction is extremely advantageous for maintaining the durability of the toy glider. First, the wings of any toy glider are susceptible to breakage. With this design, the hinge pin 64 can be removed and the wing 16 and attached wing hinge piece 46 can be replaced as a unit. Alternatively, each wing 16 can be manufactured such that it is press-fit into the wing hinge piece 46, allowing replacement of the wing without hinge assembly dismantling. Second, because the hinge spring 60 is mounted entirely within the hinge assembly 32 and protected by the rigid surfaces surrounding the hinge spring cutout 56, it is unlikely that the hinge spring 60 will be damaged during launch or landing of the toy glider. Even if the hinge spring 60 is broken during use, it can be easily replaced by removal of the hinge pin 64 and dismantling of the hinge assembly 32. The hinge stop 66 may be located on the upper hinge surface 70 if the wings 16 are rotated so that the upper wing surface 34 faces the nose 36, as shown in FIG. 3. Otherwise, the hinge stop 66 may be located on the lower hinge surface 72.

Figure 5:
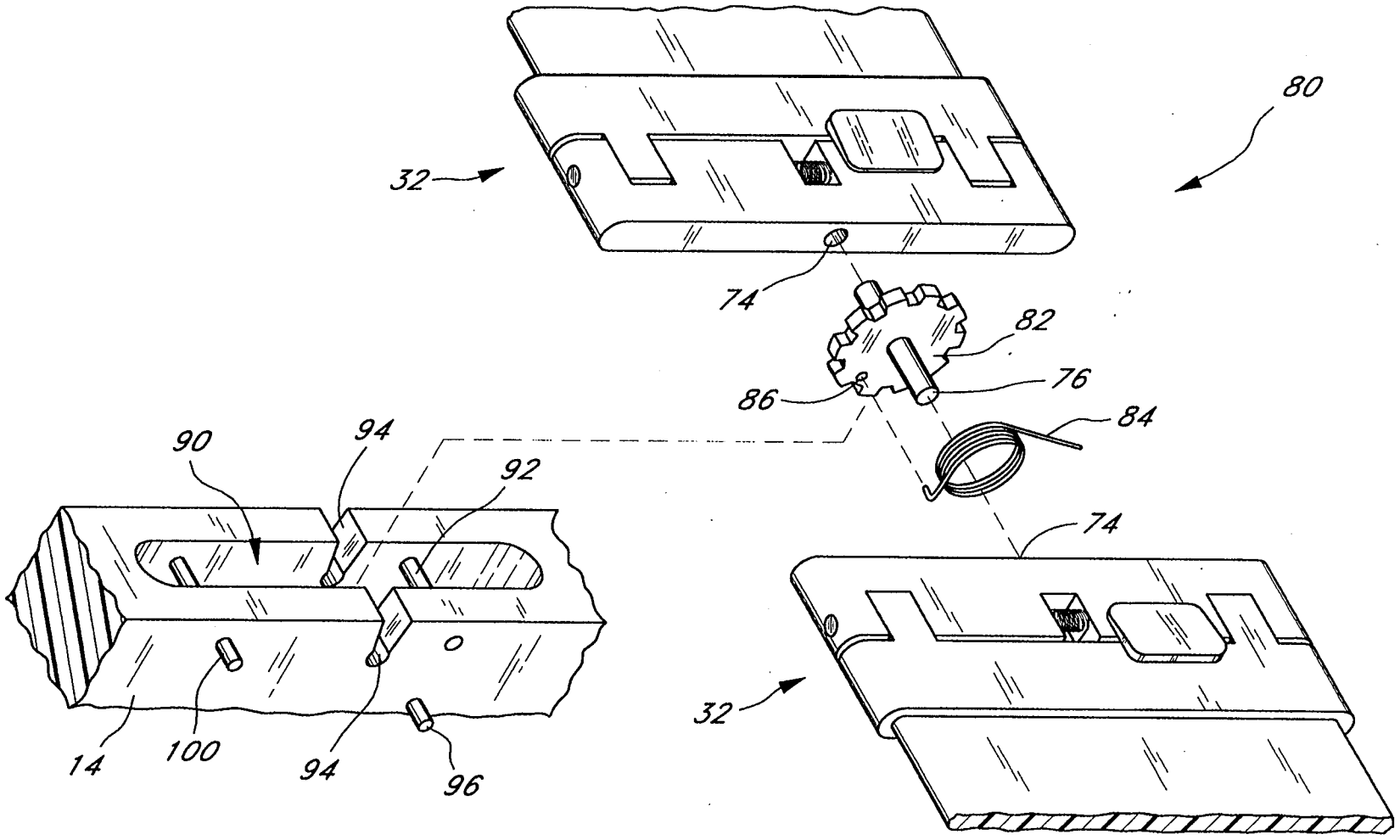
FIG. 5 is a top exploded view of the connection between the wing assembly and the fuselage illustrating the position of the fuselage pin connecting the wings, the toothed sprocket and the protected spring which applies a counter-rotational force to the wings.

As shown in FIGS. 4 and 5, each fuselage hinge piece 54 has a fuselage pin hole 74 centered opposite the hinge spring cutout 56. Illustrated in FIG. 5, the hinge assemblies 32 are secured together by a fuselage pin 76, each end of which is inserted into the fuselage pin hole 74 in each hinge assembly 32, creating the wing assembly 80. Between the two hinge assemblies, the fuselage pin 76 also has securely affixed thereto a sprocket 82 and rotatably affixed thereto a fuselage spring 84, one end of which is inserted in a spring retainer hole 86 in the sprocket 82 near the outer edge. This construction rigidly connects the two wings 16 via their respective hinge assemblies 32 and allows the wings 16 to rotate to a vertical position as a single unit, as shown in FIG. 3.

As shown in FIG. 5, the wing assembly 80 is located perpendicular to the fuselage 14 so that the fuselage pin 76 is located within the fuselage pin cutouts 94 and the sprocket 82 is located within the sprocket cutout 90. The free end of the fuselage spring 84 is secured by the spring retainer pin 92, which is inserted through the fuselage 14. The wing assembly 80 is kept in place by the retention of the fuselage pin 76 by the fuselage pin cutouts 94 and the downward force exerted on the fuselage pin 76 by the fuselage spring 84 and spring retaining pin 92. The wing assembly 80, however, is free to rotate around an axis through the center of the fuselage pin 76. The range of wing assembly rotation is limited in one direction by the rotation stop pin 96 and in the other direction by the counter-rotation stop pin 100. These stop pins are inserted through the fuselage 14 and protrude from the fuselage sides. The sprocket 82 rotates within the sprocket cutout 90. This construction is also advantageous for achieving toy durability. The fuselage spring 84 which counter-rotates the wings is contained entirely within the fuselage 14 and is protected by the rigid surfaces of the surrounding sprocket cutout 90. One of ordinary skill will recognize that the wing assembly disclosed above may be modified in a number of ways.

Figure 6A:
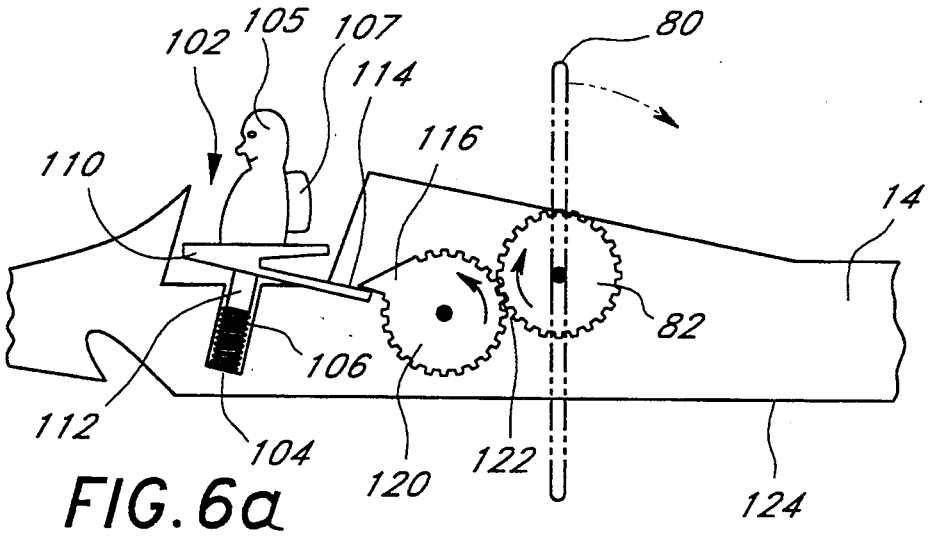
FIGS. 6*a*, 6*b* and 6*c* are sectional side views of the fuselage taken on line 2—2 of FIG. 2 illustrating the small toy ejection mechanism.
Figure 6B:
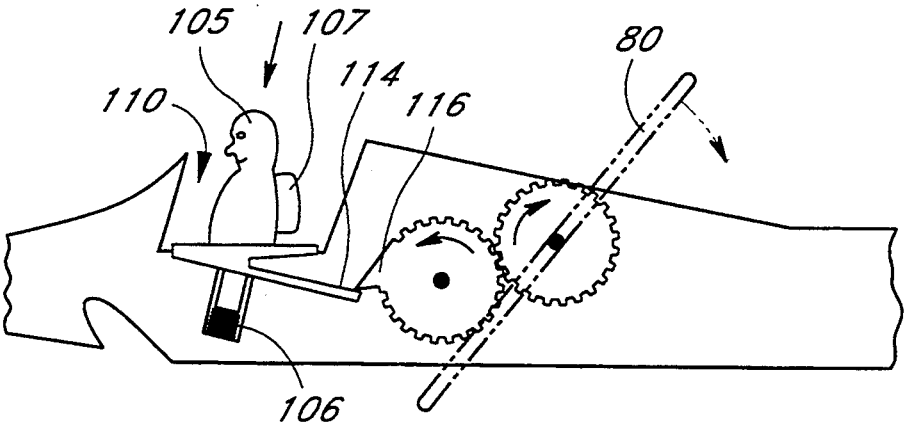
Figure 6C:
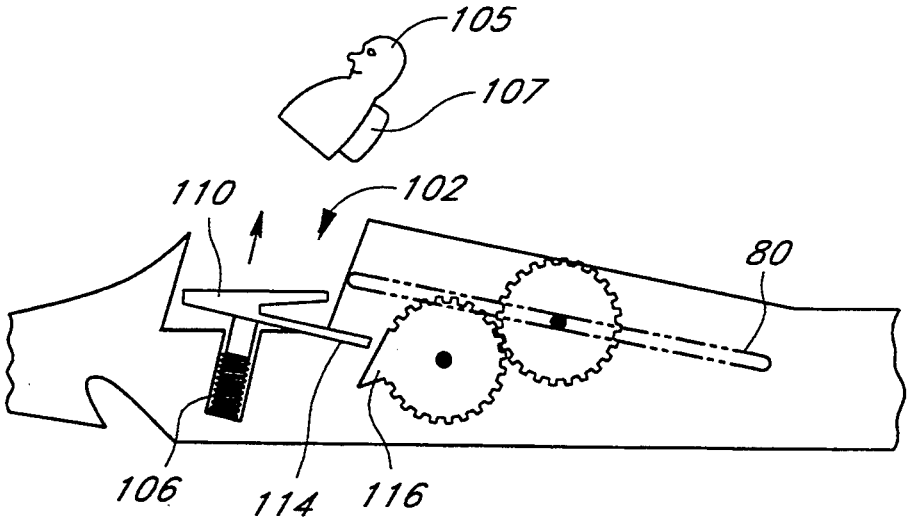

Referring to FIG. 6*a–c*, the fuselage 14 is constructed with a cockpit 102. Within the cockpit 102 is a spring hole 104. The cockpit spring 106 is retained within the spring hole 104. A seat 110, which can be attached to a toy figure 105, is placed and retained within the cockpit 102 by a seat stem 112 which fits into the spring hole 104. A seat lever protrudes from the seat 110 into the sprocket cutout. A lever catch 116 on a gear 120 meshed with the sprocket teeth 122 engages the seat lever 114 during the counter-rotation of the wing assembly 80 after launch of the toy glider. As shown in FIG. 6*a*, the lever catch 116 first engages the seat lever 114 during initial counter-rotation of the wing assembly 80. FIG. 6*b* illustrates the lever catch beginning to depress the seat 110 via the seat lever 114 against the force of the cockpit spring 106 as the wing assembly 80 further counter-rotates, compressing the cockpit spring 106. As the wing assembly 80 completely counter-rotates to its flight position, the lever catch 116 travels past the seat lever 114, releasing the seat 110 as shown in FIG. 6*c*. The force of the cockpit spring 106 then ejects the toy figure 105 located in the cockpit 102. A parachute 107 attached to the toy figure 105 is deployed when the toy figure is ejected from the cockpit 102. If the wing assembly 80 is constructed to counter-rotate in a direction opposite that shown in FIG. 6, the gear 120 and sprocket 82 can be replaced by an untoothed sprocket with a lever catch 116 which would then perform exactly as the gear 120 in FIG. 6.

The toy ejection mechanism can take a number of alternative forms. Rather than using the counter-rotating force of the wing assembly 80 to compress, then release the cockpit spring 106, the cockpit spring 106 can be compressed manually and retained in a compressed state by either a catch mounted on the seat 110, seat stem 112 or seat lever 114. This catch can then be triggered to release by a protrusion on the gear 120 or sprocket 82. The seat 110 can be configured a number of ways. It can be retained in the cockpit 102, and the toy figure to be ejected can be loosely fitted into the cockpit 102, resting against the seat 110. When the cockpit spring 106 is released, the seat 110 then pushes the toy figure vertically out of the cockpit 102, with the seat 110 remaining attached to the glider. Alternatively, the seat 110 can be part of the toy figure itself and ejected from the glider with the toy figure. The cockpit spring 106 can be retained in the spring hole 104 and remain with the glider after the toy figure is ejected, or it can be retained on the seat stem 112 and ejected from the glider with the seat 110.

Other toy ejection mechanisms can be implemented on the fuselage underside 124. These mechanisms would be similar to the cockpit ejection mechanism but would eject the toy downward from the glider rather than upward. This would allow the glider to simulate dropping bombs, launching rockets, or ejecting fuel tanks. An ejection mechanism on the fuselage underside 124 would also be capable of the in-flight launching of a second, smaller fixed-wing toy glider.

Figure 7:
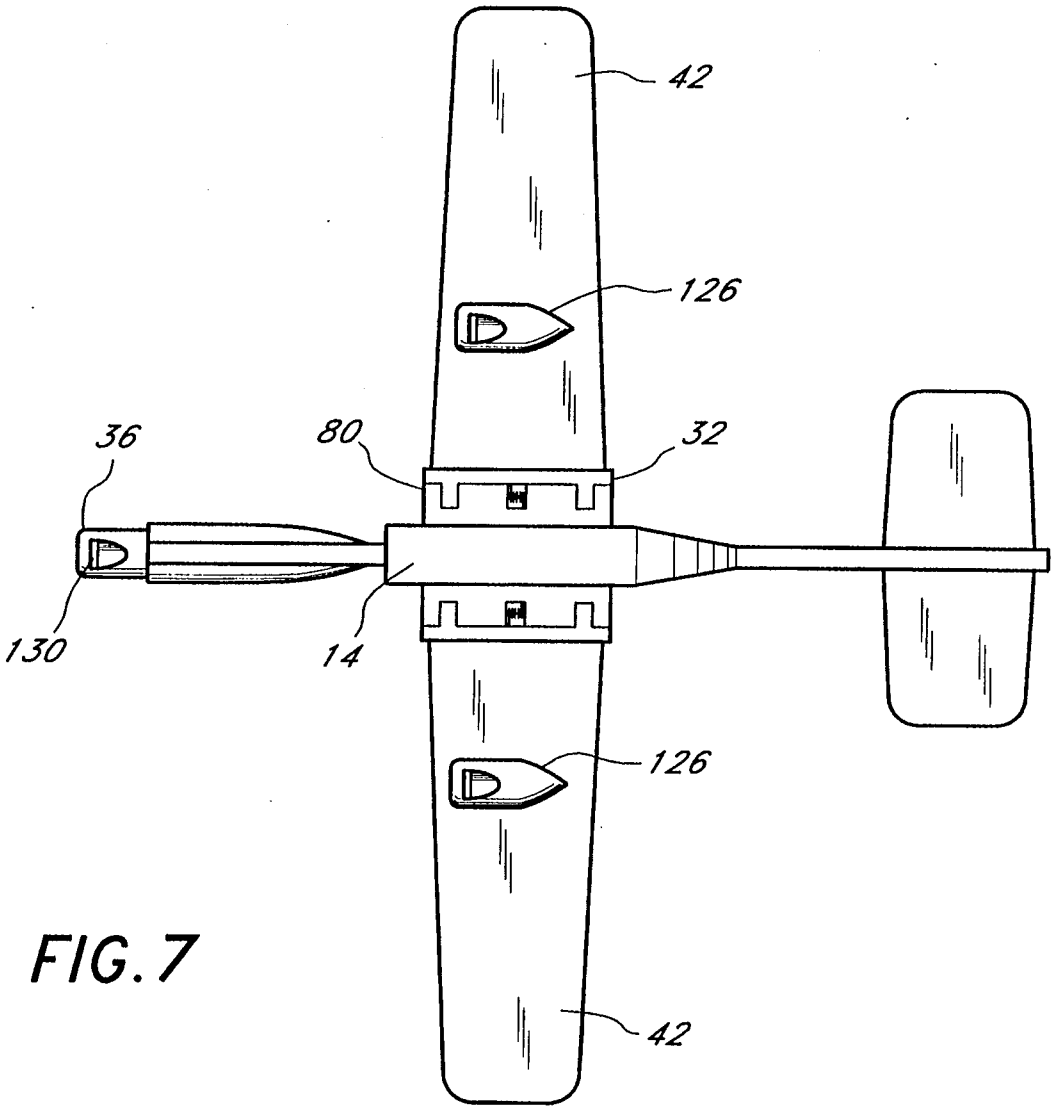
FIG. 7 is a bottom plan view illustrating whistles mounted under the wings and in the nose.

As shown in FIG. 7, in order to add auditory effects to the toy glider, wing whistles 126 may be added under each wing and made to appear as engine pods. The wing whistles 126 are activated by the flow of air through the whistles after the hinge assemblies 32 unfold and the wing assembly 80 counter-rotates to its flight position. Alternatively, a single nose whistle 130 can be mounted in the fuselage 14 at the nose 36. Other alternatives are to mount two whistles on either side of the fuselage 14 near the nose 36, directly under the fuselage 14 to simulate a fuel tank, or on the wing tips 42 to simulate wing-mounted fuel tanks. If whistles are mounted on the wings, the auditory effect begins only after the wings are deployed, because little or no airflow through the whistles would occur while the wings are folded against the tail. If the whistles are mounted on portions of the glider other than the wings, the auditory effect begins immediately upon launch of the toy glider. If more than one whistle is mounted on the toy glider, each whistle can be constructed to emit sound at different pitches which are harmonized to create more pleasing sounds.

Figure 8:
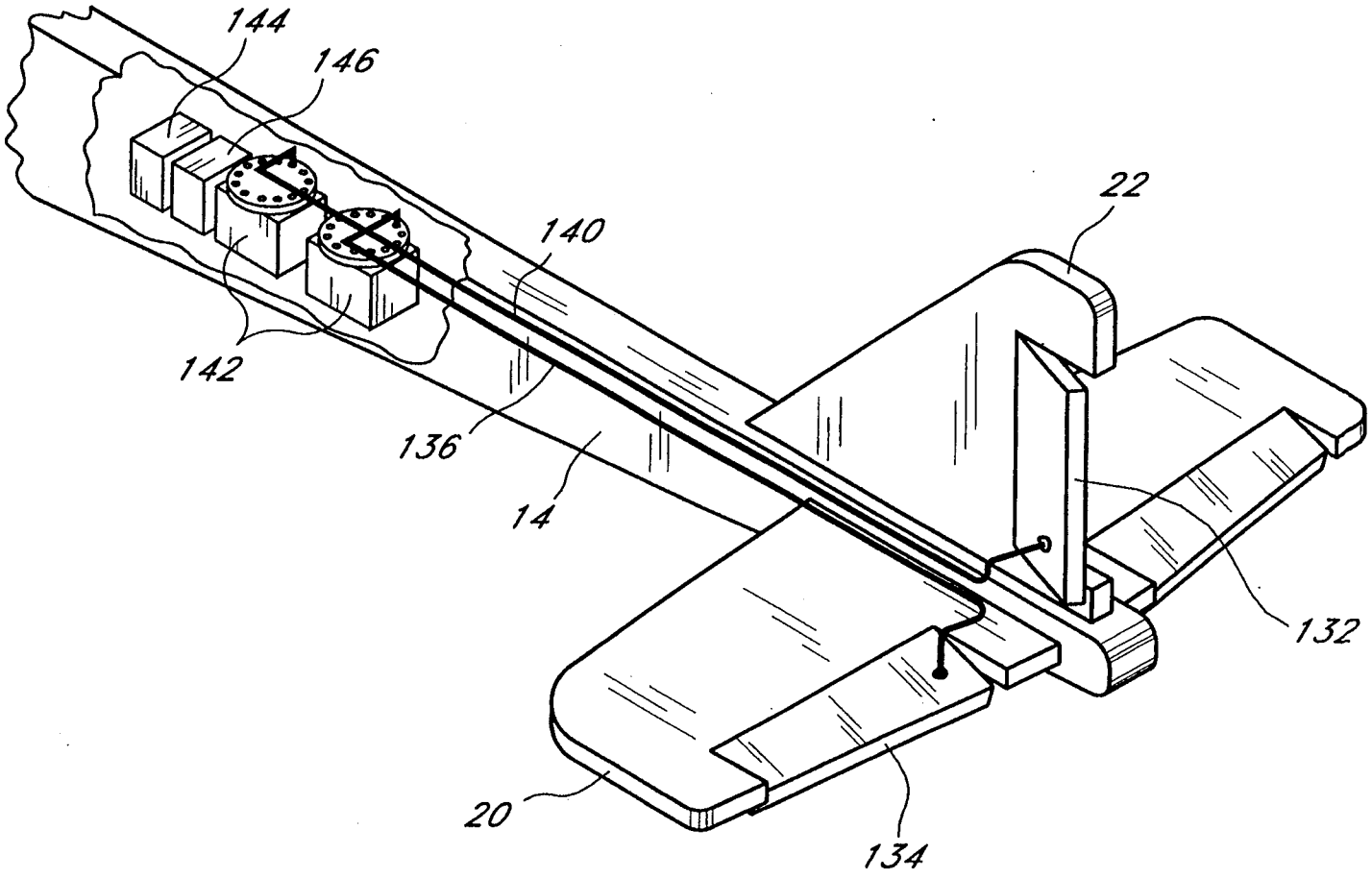
FIG. 8 is a top perspective view of the tail section, illustrating the elevator and rudder push-rod controls.

Referring to FIG. 8, steering of the toy glider after launch can be achieved by conventional radio remote control through manipulation of the position of a rudder 132 on the vertical stabilizer 22 and the position of an elevator 134 on the horizontal stabilizers 20. The positions of the rudder 132 and elevator 134 are independently determined by the position of the elevator pushrod 136 and the rudder pushrod 140. These pushrods are connected to standard, readily available servos 142 which are in turn controlled by a radio receiver 144 and battery power 146 source, all of which can be attached to the fuselage 14. Alternatively, these steering surfaces can be controlled by a string, thin gauge wire, or other flexible linkage connected to the servos in a manner to exert a pulling force on the steering surfaces. Steering surfaces can also be located on the wings in the form of ailerons. If ailerons are used, because of the foldback wings, a servo on the fuselage would have to control the ailerons via a flexible linkage. Pushrods or flexible linkages can be located externally to the fuselage as shown in FIG. 8 or internally to the fuselage. Pushrods or flexible linkages can be directly connected to the rudder 132 and elevator 134 as shown in FIG. 8. Alternatively, the pushrods or flexible linkages can be connected so as to rotate the hinge rods connecting the rudder 132 and elevator 134 to the vertical stabilizer 22 or horizontal stabilizer 20, thus indirectly controlling these steering surfaces. One of ordinary skill will recognize that the steering surfaces and control mechanisms disclosed above may be modified in a number of ways.

The toy glider has been disclosed in detail in connection with the preferred embodiments, but these embodiments are disclosed by way of examples only and are not to limit the scope of the present invention, which is defined by the claims that follow. One of ordinary skill in the art will appreciate many variations and modifications within the scope of this invention.

What is claimed is:

1. A toy aircraft glider, comprising:

a fuselage having a longitudinal axis and a tail at one end;

a wing protruding from said fuselage along an axis generally perpendicular to said longitudinal axis and having a tip distal said fuselage;

a first hinge connected to said wing proximate said fuselage for folding said wing from said perpendicular axis in a plane containing said perpendicular axis and generally perpendicular to said longitudinal axis;

a first spring means contained within the bounds of said first hinge for urging said wing to rotate about said first hinge, said wing tip being urged toward said perpendicular axis:

a second hinge joining said first hinge to said fuselage, for rotating said wing about said perpendicular axis; and a second spring means contained within the bounds of said fuselage for urging said wing to rotate about said second hinge, said wing tip being urged away from said tail.

2. The toy aircraft glider of claim 1, further comprising:

a trigger selectively retaining and releasing said pilot figure in said cockpit, said trigger being actuated by rotation of said wing; and third spring means for ejecting said pilot figure from said cockpit upon release of said trigger.

3. The toy aircraft glider of claim 1, further comprising:

a whistle attached to said wing.

4. The toy aircraft glider of claim 1, further comprising:

a horizontal stabilizer at said tail;

an elevator attached to said horizontal stabilizer;

a vertical stabilizer at said tail;

a rudder attached to said vertical stabilizer; and a radio remote control for independently controlling the position of said elevator relative to said horizontal stabilizer and the position of said rudder relative to said vertical stabilizer.

5. A toy aircraft glider which may be launched from a hand held slingshot in the fashion of a toy rocket, comprising:

a fuselage having a longitudinal axis, a nose defining a first end, a tail defining a second end and a cockpit proximate said nose;

first and second wings protruding from opposing sides of said fuselage along an axis generally perpendicular to said longitudinal axis, each of said wings having a proximal end proximate said fuselage, a distal end distal said fuselage, and a generally planar surface bounded by a leading edge and an opposed trailing edge;

a horizontal stabilizer protruding from both sides of said fuselage proximate said tail along an axis generally perpendicular to said longitudinal axis, having a generally planar surface bounded by a leading edge and an opposed trailing edge;

a vertical stabilizer protruding from fuselage proximate said tail along an axis generally perpendicular to said longitudinal axis and generally perpendicular to said horizontal stabilizer, having a generally planar surface bounded by a leading edge and an opposed trailing edge;

first and second hinges connected to the proximal ends of said first and second wings, respectively, which allow said wings to fold relative to said fuselage;

first and second springs associated with said first and second hinges, respectively, and contained within said first and second hinges, respectively, that urge said first and second wings, respectively, toward said generally perpendicular axis;

a pin connected to said first and second wings and retained by said fuselage, allowing said first and second wings to rotate about said generally perpendicular axis;

a third spring contained within said fuselage and associated with said pin that urges said first and second wings so that said leading edges are proximate said nose and said trailing edges are distal said nose;

a pilot figure in said cockpit having a parachute;

a fourth spring urging said pilot figure from said cockpit; and a triggering means connected to said pin which releasably retains said pilot figure in said cockpit until said first and second wings are aligned along said generally perpendicular axis and said leading edges are proximate said nose whereby said first and second hinges and said pin allow said first and second wings to be rotated and folded back toward said tail so that said distal ends of said first and second wings may be urged together against said tail to reduce drag and facilitate launching of said toy aircraft from said hand held slingshot in the fashion of a toy rocket, said first, second and third springs urge said first and second wings toward said generally perpendicular axis and said leading edges toward said nose so that said toy aircraft may fly like a toy glider, and said triggering means may allow said fourth spring to eject said pilot figure from said cockpit.

6. A toy aircraft as recited in claim 1, further comprising:

a first and second wing whistle associated with said first and second wings, respectively;

whereby said first and second wing whistles emit an audible sound only after the said first and second wings are aligned along said generally perpendicular axis so that said leading edges are proximate said nose and said trailing edges are distal said nose.

7. A toy aircraft as recited in claim 1, further comprising:

a nose whistle associated with the fuselage proximate said nose whereby said nose whistle emits an audible sound immediately upon launch of said toy aircraft.

8. A toy aircraft as recited in claim 1, further comprising:

an elevator proximate said trailing edge of said horizontal stabilizer having a generally planar surface bounded by a leading edge and an opposed trailing edge whereby said elevator leading edge is fixed with respect to said horizontal stabilizer and said elevator trailing edge is rotatable with respect to said elevator leading edge;

a rudder proximate said trailing edge of said vertical stabilizer having a generally planar surface bounded by a leading edge and an opposed trailing edge whereby said rudder leading edge is fixed with respect to said vertical stabilizer and said rudder trailing edge is rotatable with respect to said rudder leading edge; and a radio remote control means for independently rotating said elevator trailing edge and said rudder trailing edge about said elevator leading edge and said rudder leading edge, respectively, after launch of said toy aircraft.

* * * * *

UNITED STATES PATENT AND TRADEMARK OFFICE

CERTIFICATE OF CORRECTION

PATENT NO. : 5,423,706

DATED : June 13, 1995

INVENTOR(S) : George W. Chase

It is certified that error appears in the above-indentified patent and that said Letters Patent is hereby corrected as shown below:

Column 6, line 8, change "lever catch beginning" to -- lever catch 116 beginning--

Signed and Sealed this

Twentieth Day of February, 1996

*Attest:*

Bruce Lehman

BRUCE LEHMAN

*Attesting Officer*

*Commissioner of Patents and Trademarks*